US009146071B2

(12) United States Patent
Liu

(10) Patent No.: US 9,146,071 B2
(45) Date of Patent: Sep. 29, 2015

(54) QUICK-RELEASE DEVICE FOR A CROSSBOW STOCK ASSEMBLY

(71) Applicant: Poe Lang Enterprise Co., Ltd., Taichung (TW)

(72) Inventor: Chi-Chang Liu, Taichung (TW)

(73) Assignee: Poe Lang Enterprise Co., Ltd., Taichung (TW)

( * ) Notice: Subject to any disclaimer, the term of this patent is extended or adjusted under 35 U.S.C. 154(b) by 91 days.

(21) Appl. No.: 14/140,984

(22) Filed: Dec. 26, 2013

(65) Prior Publication Data

US 2015/0184971 A1 Jul. 2, 2015

(51) Int. Cl.

| | |
|---|---|
| ***F41B 5/12*** | (2006.01) |
| ***F41C 23/14*** | (2006.01) |
| ***F41B 5/14*** | (2006.01) |
| ***F41C 23/20*** | (2006.01) |

(52) U.S. Cl.

CPC ..... *F41B 5/1403* (2013.01); *F41B 5/12* (2013.01); *F41C 23/14* (2013.01); *F41C 23/20* (2013.01)

(58) Field of Classification Search

CPC ..... F41B 5/123; F41B 5/12; F14C 23/14
USPC ..... 124/25, 86, 88; 42/71.01, 73
See application file for complete search history.

(56) References Cited

U.S. PATENT DOCUMENTS

| | | | | |
|---|---|---|---|---|
| 4,594,994 | A * | 6/1986 | Williams | 124/25 |
| 5,119,797 | A * | 6/1992 | Anderson | 124/25 |
| 5,522,373 | A * | 6/1996 | Barnett | 124/25 |
| 5,553,596 | A * | 9/1996 | Bednar | 124/25 |
| 5,931,145 | A * | 8/1999 | Oviedo-Reyes | 124/20.3 |
| 6,651,371 | B2 * | 11/2003 | Fitzpatrick et al. | 42/72 |
| 6,868,845 | B1 * | 3/2005 | Moore | 124/25 |
| 6,925,744 | B2 * | 8/2005 | Kincel | 42/71.01 |
| 7,363,740 | B2 * | 4/2008 | Kincel | 42/71.01 |
| 7,748,370 | B1 * | 7/2010 | Choma | 124/25 |
| 7,810,480 | B2 * | 10/2010 | Shepley et al. | 124/25 |
| 7,823,572 | B2 * | 11/2010 | Anderson | 124/25 |
| 7,891,348 | B2 * | 2/2011 | Colley | 124/25 |
| 7,930,849 | B2 * | 4/2011 | Abraham et al. | 42/73 |
| 7,997,258 | B2 * | 8/2011 | Shepley et al. | 124/25 |
| 8,033,275 | B2 * | 10/2011 | Bednar et al. | 124/25 |
| 8,240,299 | B2 * | 8/2012 | Kronengold et al. | 124/25 |
| 8,443,539 | B2 * | 5/2013 | Cabahug et al. | 42/85 |
| 8,671,923 | B2 * | 3/2014 | Goff et al. | 124/25 |
| 8,701,641 | B2 * | 4/2014 | Biafore, Jr. | 124/25 |
| 8,701,642 | B2 * | 4/2014 | Biafore et al. | 124/25 |
| 8,813,735 | B2 * | 8/2014 | Biafore et al. | 124/25 |

(Continued)

*Primary Examiner* — Melba Bumgarner
*Assistant Examiner* — Alexander Niconovich
(74) *Attorney, Agent, or Firm* — C. G. Mersereau; Nikolai & Mersereau, P.A.

(57) ABSTRACT

A quick-release device for a crossbow stock assembly includes a main body having a fixing member which is threadedly connected to the extension of the stock. An axial groove is defined in the outside of the threaded section of the extension. A locking member is pivotably connected to the fixing member and positioned between a locked position and a release position. The locking member has an engaging end and a press end. The engaging end is engaged with the axial groove when the locking member is located at the locked position, and the engaging end is separated from the axial groove when the locking member is located at the release position. A collar is threadedly connected to the threaded section to keep the locking member at the locked position. The stock is quickly installed to or removed from the main body of the crossbow.

8 Claims, 9 Drawing Sheets

(56) References Cited

U.S. PATENT DOCUMENTS

| | | | | |
|---|---|---|---|---|
| 8,919,332 | B2 * | 12/2014 | Trpkovski | 124/23.1 |
| 8,991,373 | B2 * | 3/2015 | Cummings | 124/20.3 |
| 9,022,013 | B2 * | 5/2015 | Trpkovski | 124/25 |
| 2008/0127956 | A1 * | 6/2008 | Bednar et al. | 124/25 |
| 2008/0251058 | A1 * | 10/2008 | Colley | 124/25 |
| 2010/0170489 | A1 * | 7/2010 | Shepley et al. | 124/25 |
| 2011/0030666 | A1 * | 2/2011 | Darlington | 124/25 |

* cited by examiner

QUICK-RELEASE DEVICE FOR A CROSSBOW STOCK ASSEMBLY

BACKGROUND OF THE INVENTION (1) Fields of the Invention

The present invention relates to a crossbow, and more particularly, to a quick-release device of the stock assembly of the crossbow to allow the stock quickly to be connected to or removed from the crossbow.

(2) Descriptions of Related Art

The conventional crossbow 10 is disclosed in FIGS. 1 to 4, and generally comprises a threaded hole 11 and a positioning slot 12 defined in an end face thereof. A stock 13 has a threaded rod 14 extending therefrom so as to be connected with the threaded hole 11. The threaded rod 14 has an axial groove 140. A positioning member 15 is mounted to the threaded rod 14 by its mounting hole 150. A fixing collar 16 is threadedly connected to the threaded rod 14 and located behind the positioning member 15. A boss 151 extends from the inner periphery of the mounting hole 150 of the positioning member 15 and is engaged with the axial groove 140 to allow the positioning member 15 can only be axially movable along the threaded rod 14. A protrusion 152 extends from one side of the positioning member 15 and is engaged with the positioning slot 12. The fixing collar 16 has multiple notches 160 on the rear side thereof and a tool is engaged with the notches 160 to rotate the fixing collar 16.

As shown in FIG. 2, when the positioning member 15 is moved forward and axially to engage the protrusion 152 with the positioning slot 12, and the fixing collar 16 is rotated to tightly contact the rear side of the positioning member 15 to prevent the positioning member 15 from moving backward. The engagements between the boss 151 and the axial groove 140, and between the protrusion 152 and the positioning slot 12, the stock 13 is connected to the crossbow 10.

As shown in FIG. 3, when the fixing collar 16 is rotated away from the positioning member 15, the positioning member 15 is axially moved to remove the protrusion 152 from the positioning slot 12, such that the stock 13 together with the positioning member 15 are rotated, and the threaded rod 14 is separated from the threaded hole 11, and the stock 13 is separated from the crossbow 10.

FIG. 4 shows that the threaded rod 14 has a slide rod 141 along which the stock part 130 of the stock 13 is axially moved. The stock part 130 has an adjustment device 131 to position the stock part 130 relative to the slide rod 141 to adjust the length of the stock 13 for different users.

However, the fixing collar 16 has to be rotated to be tightened or loosened by a special tool, and this is not convent for the users. Besides, the positioning member 15 and the fixing collar 16 are exposed between the crossbow 10 and the stock 13, so that they are easily touched and rotated to cause the stock 13 to be loosened. The stock 13 can only be adjusted a limited distance "A" as shown. The restriction of the adjustment may not be suitable for users of different sizes.

The present invention intends to provide a stock assembly of a crossbow and improves the shortcomings mentioned above.

SUMMARY OF THE INVENTION

The present invention relates to a crossbow quick-release device wherein the crossbow has a main body, a connection rod extending from the rear end of the main body. The crossbow has a fixing member which has a threaded hole with which the threaded section of the extension is connected. An axial groove is defined in the outside of the threaded section and communicates with the front end of the threaded section. The locking member is pivotably connected to the fixing member and positioned between a locked position and a release position. The locking member has an engaging end and a press end on two ends thereof. The engaging end is engaged with the axial groove when the locking member is located at the locked position, and the engaging end is separated from the axial groove when the locking member is located at the release position. The spring provides a force to bias the locking member at the locked position.

The collar is threadedly connected to the threaded section to keep the locking member at the locked position to prevent the threaded section of the connection rod from unscrewing from the threaded hole of the fixing member, such that the stock is connected to the main body of the crossbow.

When the collar is loosened, the user may push press end to remove the engaging from the axial groove, so that the threaded section of the connection rod is removed from the fixing member to quickly separate the stock from the main body of the crossbow. There will be no tool needed to install or uninstall the stock. The collar is located the front end of the extension of the stock and is not rotated unintentionally.

The connection rod has a rail formed on the underside thereof, and multiple positioning slots are defined transversely through the rail. The fixing member has a sliding slot and a through hole which is defined through two sidewalls of the sliding slot. The rail is slidably engaged with the sliding slot. A bolt extends through the through hole and is engaged with one of the positioning slots. A nut is connected to the bolt. By the movement of the rail relative to the sliding slot, the bolt is engaged with one of the positioning slots so as to adjust the first stage of length of the stock.

Besides, the stock has an adjustment device connected thereto so as to position the stock part to the extension. This feature allows the user to adjust the second stage of length of the stock such that the users of different sizes can use the crossbow.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
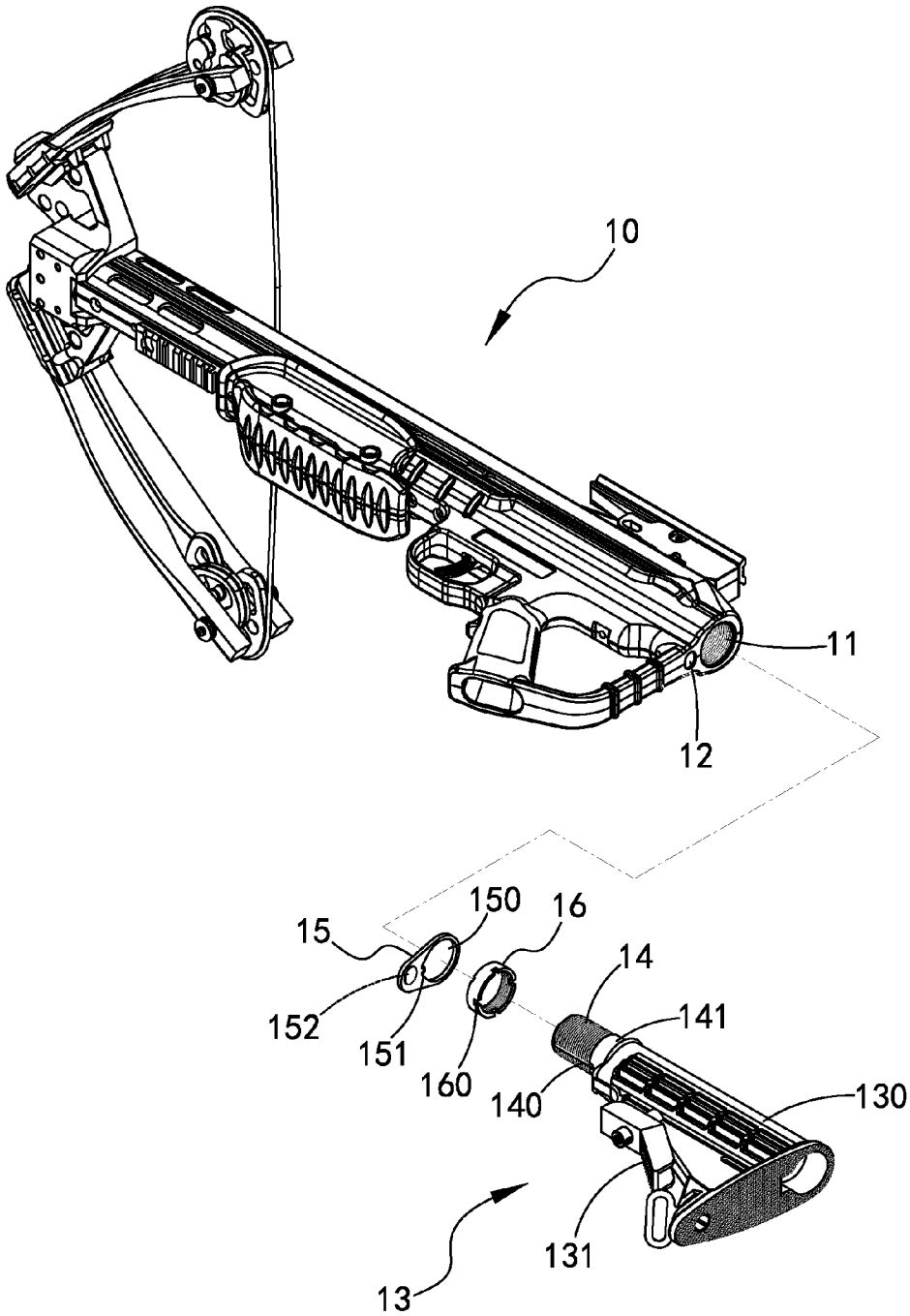
FIG. 1 PRIOR ART
FIG. 1 is an exploded view of the conventional crossbow.
Figure 2:
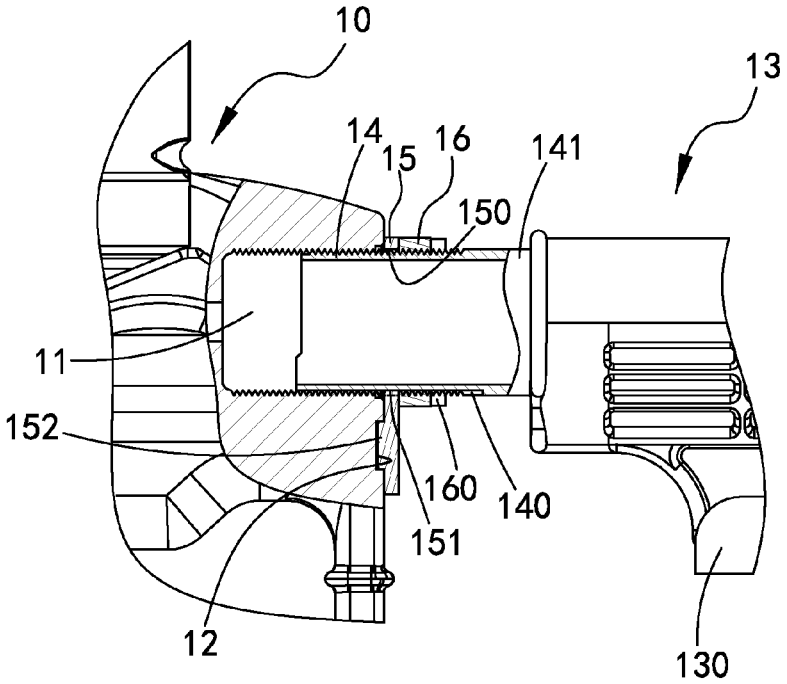
FIG. 2 PRIOR ART
FIG. 2 is a cross sectional view of the connection between the stock and the conventional crossbow.
Figure 3:
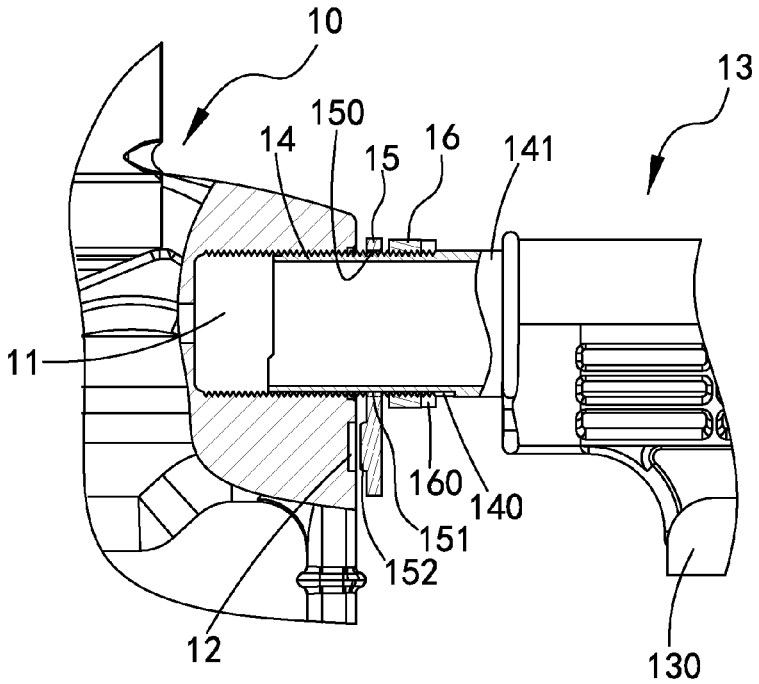
FIG. 3 PRIOR ART
FIG. 3 shows that the stock is to be separated from the conventional crossbow.
Figure 4:
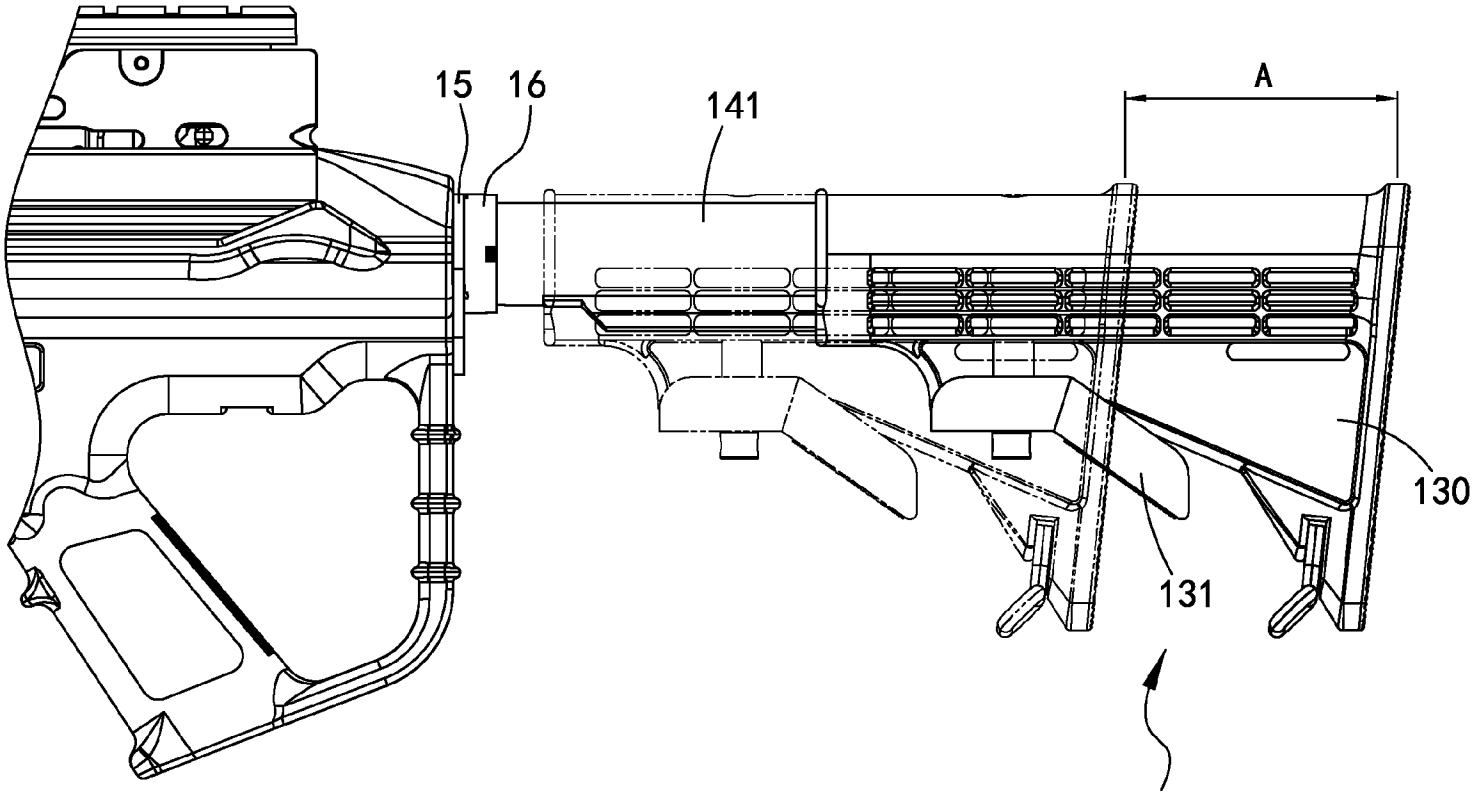
FIG. 4 PRIOR ART
FIG. 4 shows the distance that the stock can be adjusted relative to the conventional crossbow.
Figure 5:
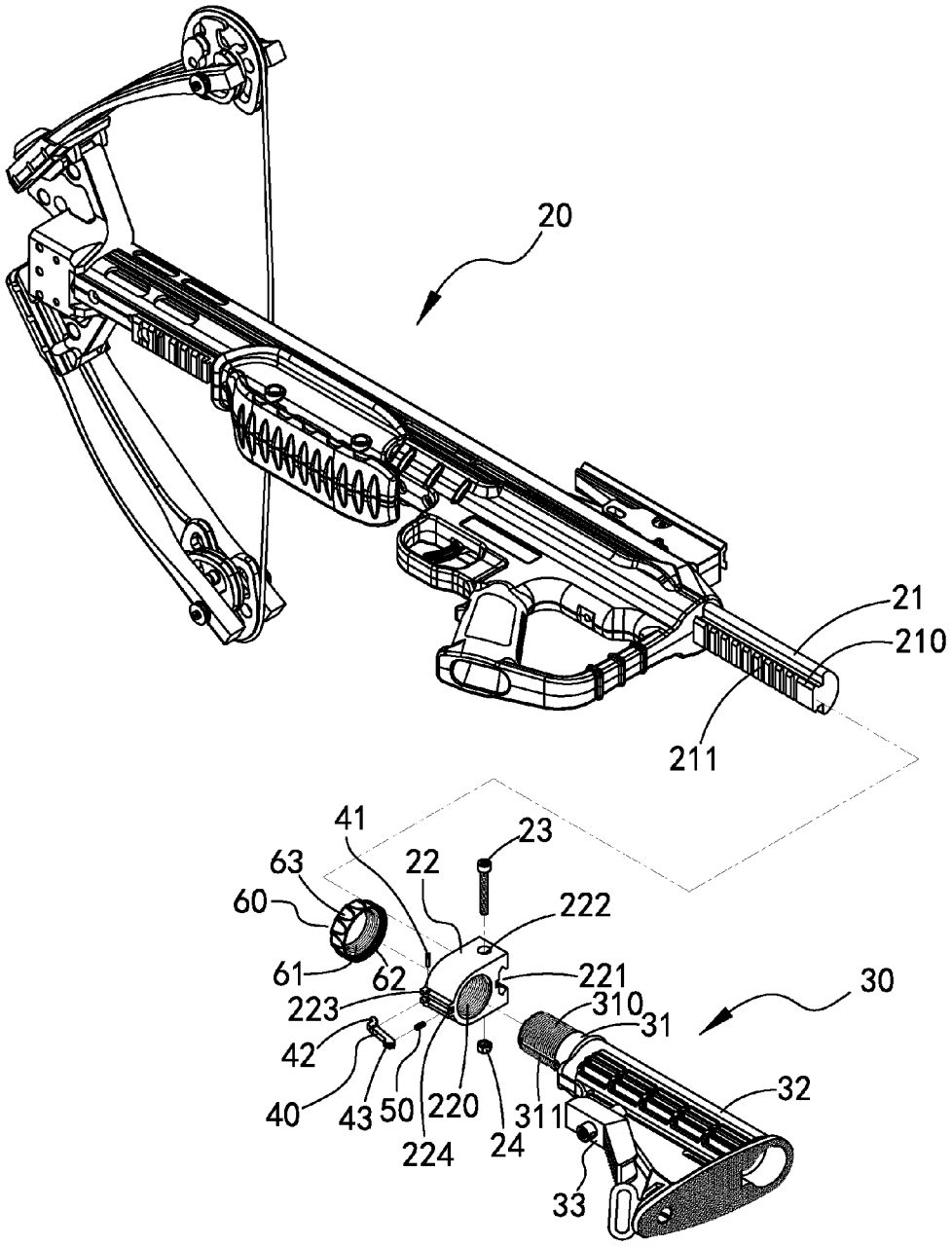
FIG. 5 is an exploded view of the main body of the crossbow, the stock and the quick-release device of the present invention.
Figure 6:
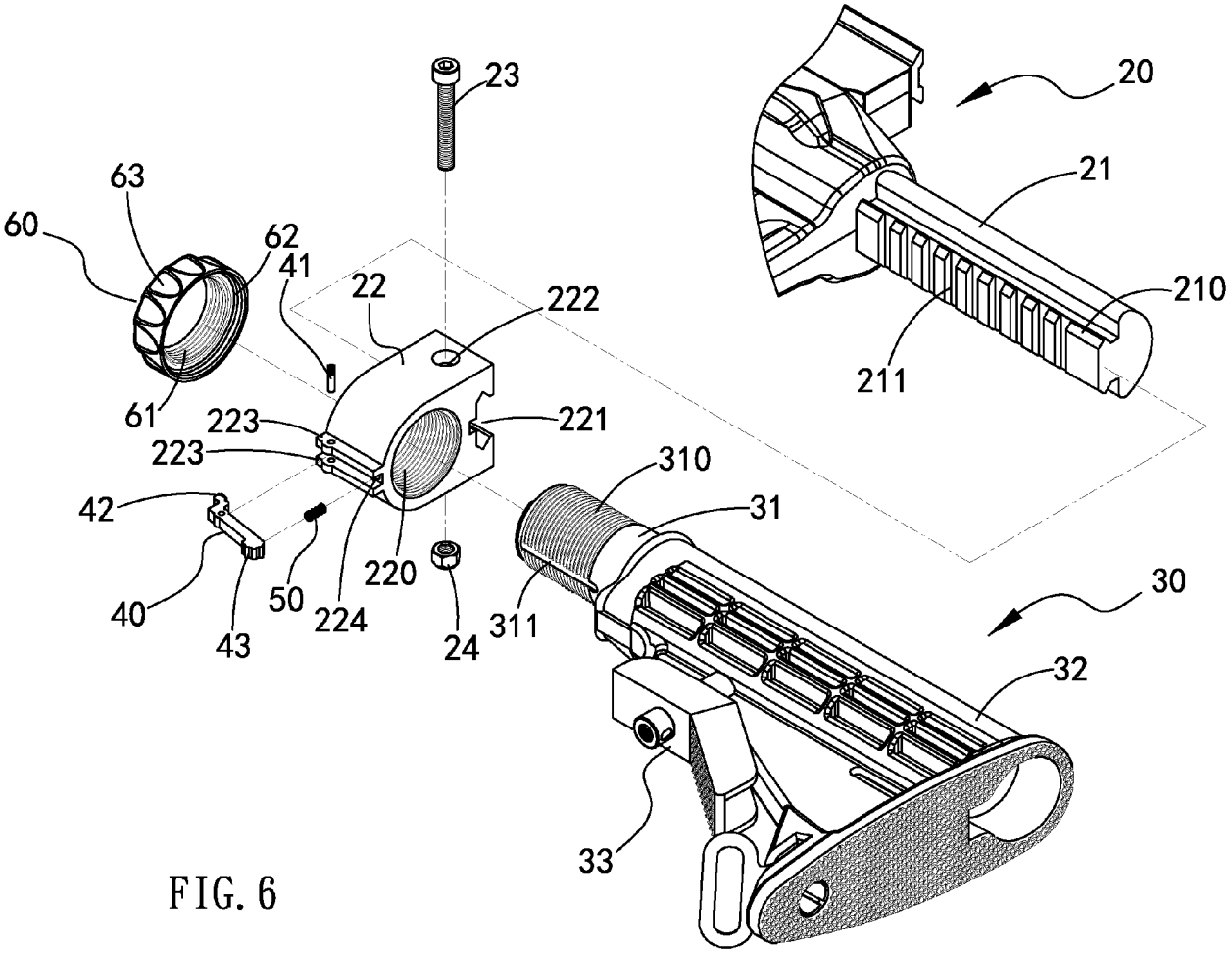
FIG. 6 is an enlarged and exploded view of the main body of the crossbow, the stock and the quick-release device of the present invention.
Figure 7:
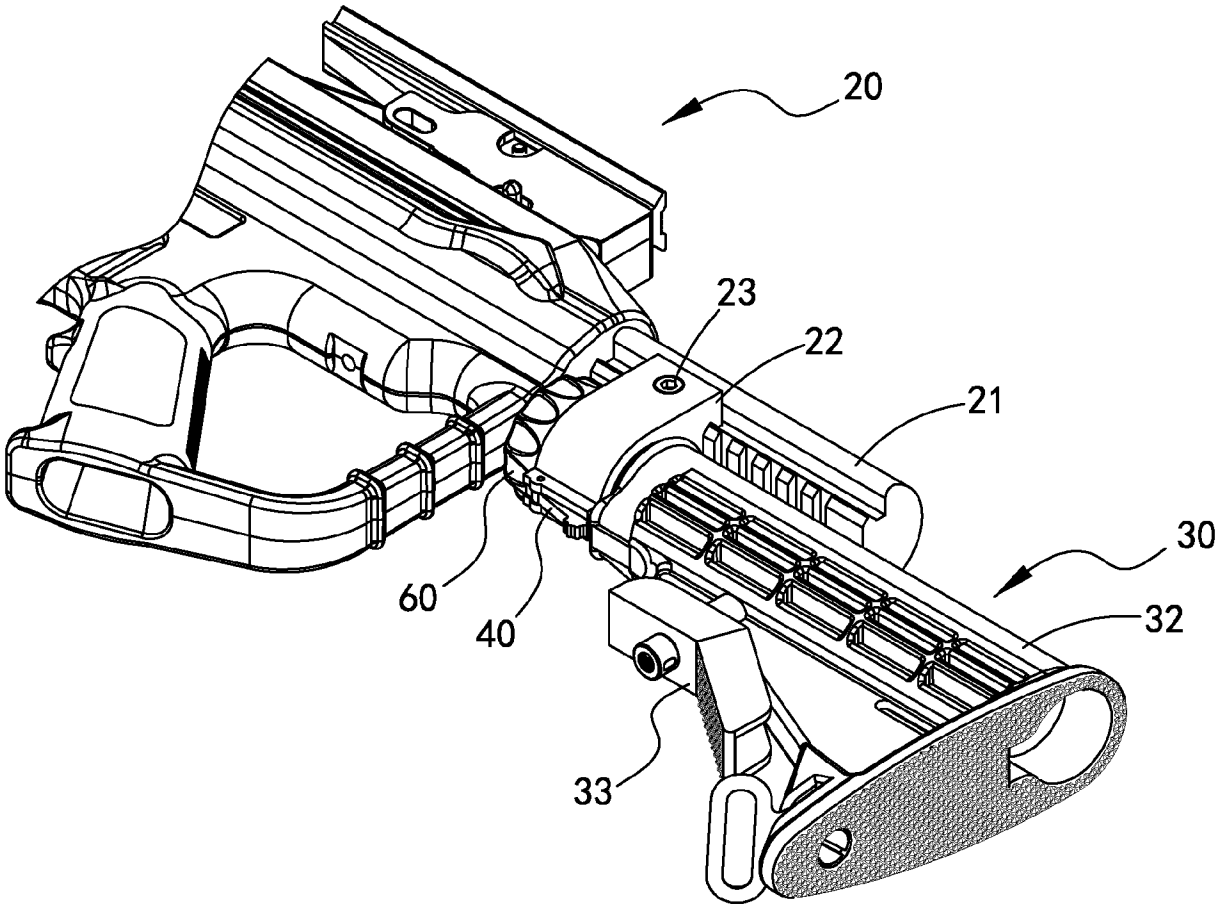
FIG. 7 is a perspective view to show that the stock assembly is connected to main body of the crossbow of the present invention.

Referring to FIGS. 5 to 11, the quick-release device of the present invention comprises a main body 20, a stock 30, a locking member 40, a spring 50 and a collar 60.

The main body 20 has a connection rod 21 extending from the rear end thereof. The connection rod 21 has a rail 210 formed on the underside thereof, and multiple positioning slots 211 are defined transversely through the rail 210. A fixing member 22 is connected to the connection rod 21 and has a threaded hole 220 defined therethrough. The fixing member 22 further has a sliding slot 221, a through hole 222 which is defined through two sidewalls of the sliding slot 221, two lugs 223 which are parallel to each other, and a stud 224 extending from the fixing member 22 and located between the two lugs 223. The rail 210 and the sliding slot 221 are dovetail-shaped, and the rail 210 is slidably engaged with the sliding slot 221. A bolt 23 extends through the through hole 222 and is engaged with one of the positioning slots 211. A nut 24 is connected to the bolt 23.

The stock 30 has an extension 31, a stock part 32 and an adjustment device 33. The extension 31 has a threaded section 310 formed on the front end thereof, and the threaded section 310 is threadedly connected with the threaded hole 220 of the fixing member 22. An axial groove 311 is defined axially in the outside of the threaded section 310 and communicates with the front end of the threaded section 310. The stock part 32 connected to the rear end of the extension 31. The adjustment device 33 positions the stock part 32 to the extension 31.

The locking member 40 is pivotably connected between the two lugs 223 of the fixing member 22 by extending a pivot 41 through the two lugs 223. The locking member 40 is pivotable between a locked position and a release position. The locking member 40 has an engaging end 42 and a press end 43 on two ends thereof. The engaging end 42 is engaged with the axial groove 311 when the locking member 40 is located at the locked position. The engaging end 42 is separated from the axial groove 311 when the locking member 40 is located at the release position. The press end 43 of the locking member 40 has a notch 44. The first end of the spring 50 is mounted to the stud 224 and the second end of the spring 50 is received in the notch 44.

The spring 50 is biased between the fixing member 22 and the locking member 40 to bias the locking member 40 at the locked position.

The collar 60 has a threaded inner periphery 61 and a restriction groove 62 is defined in one side of the collar 60 and communicates with the threaded inner periphery 61. The threaded inner periphery 61 is threadedly connected to the threaded section 310 of the extension 31. The engaging end 42 of the locking member 40 is engaged with the restriction groove 62 to keep the locking member 40 at the locked position. The collar 60 has anti-slip grooves 63 defined in the outer periphery thereof for convenient of operation to the user.

Figure 8:
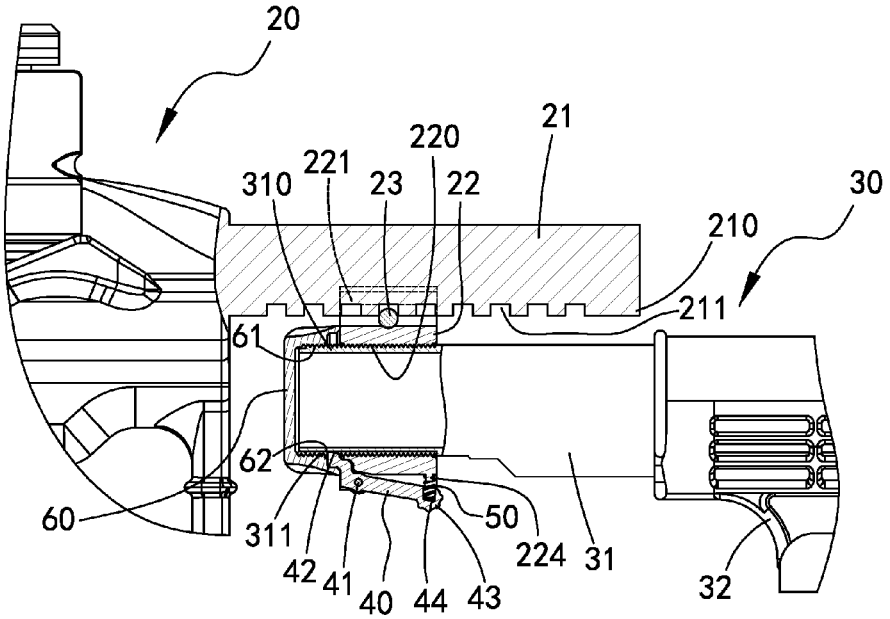
FIG. 8 is a cross sectional view of the connection between the stock assembly and the main body of the crossbow of the present invention.

As shown in FIG. 8, when the collar 60 is rotated to be tightened, the restriction groove 62 of the collar 60 restricts the locking member 40 at the locked position, so that the engaging end 42 is engaged with the axial groove 311 to prevent the threaded section 310 of the extension 31 from rotating and separating from the threaded hole 220. Therefore, the stock 30 is fixed to the main body 20 of the crossbow.

Figure 9:
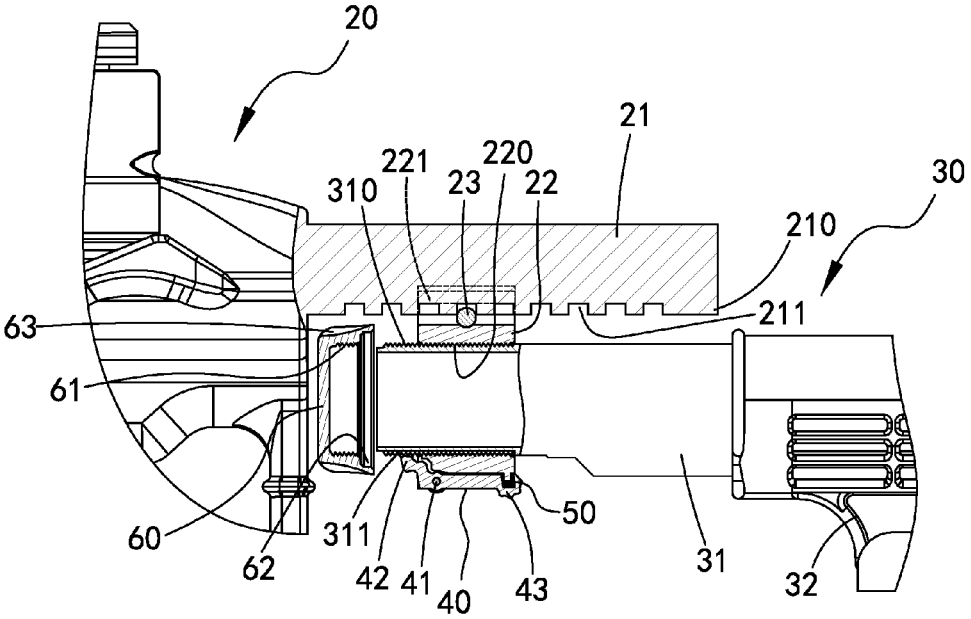
FIG. 9 is a cross sectional view to show that the locking member is pivoted to release the connection between the stock assembly and the main body of the crossbow of the present invention.

As shown in FIG. 9, when the collar 60 is rotated to be loosened, the engaging end 42 is released, so that when the press end 43 is pushed, the engaging end 42 is disengaged from the axial groove 311 so that the threaded section 310 of the extension 31 is removed from the threaded hole 220. Therefore, the stock 30 is quickly separated from the main body 20 of the crossbow.

No tool is needed to rotate the collar 60 so that the installation and removal of the stock 30 is easy. The collar 60 is located the front end of the extension 31 of the stock 30 and is not rotated unintentionally.

Figure 10:
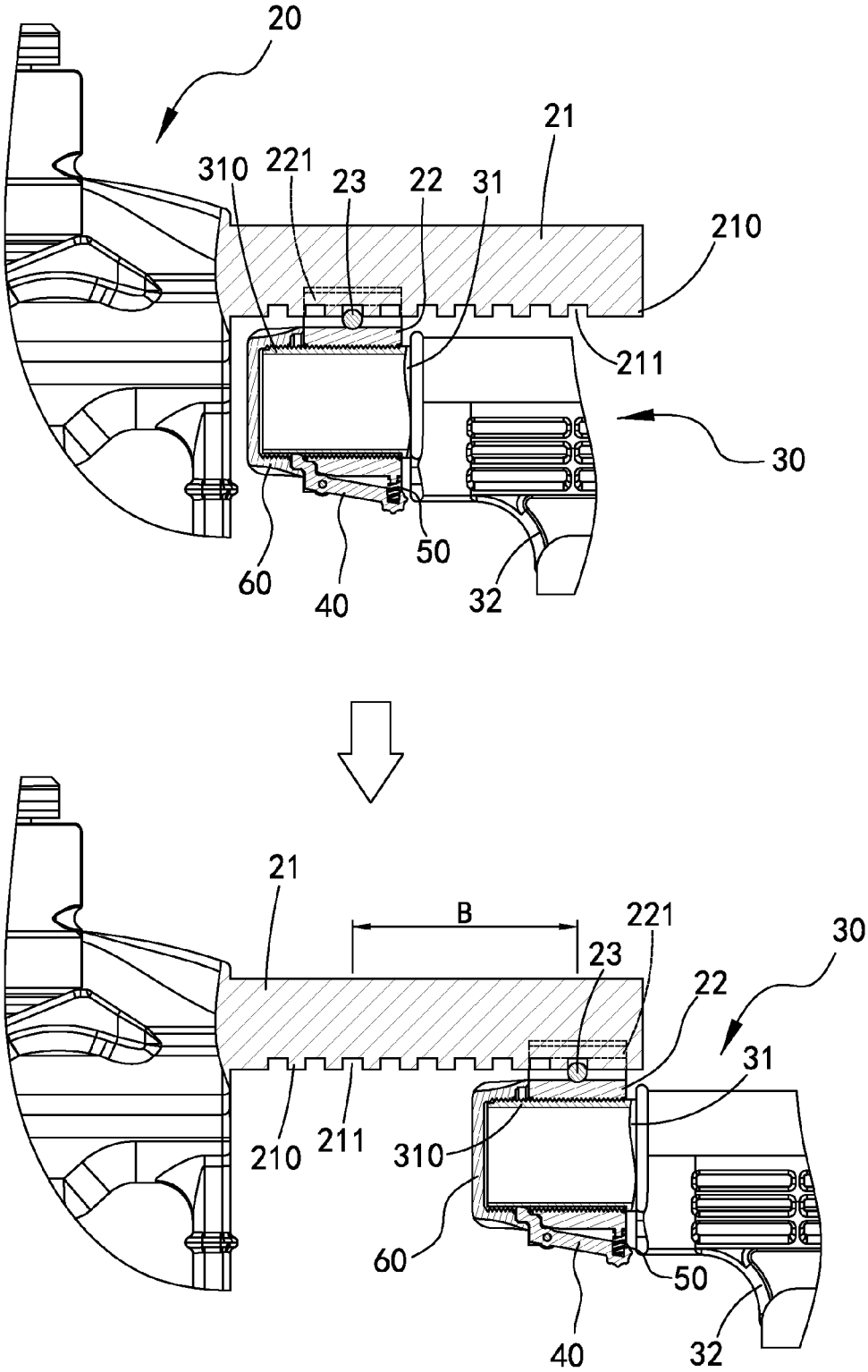
FIG. 10 shows the first stage of length of the stock assembly relative to the main body of the crossbow of the present invention.

As shown in FIG. 10, when the rail 210 is moved to a desired position in the sliding slot 221, the bolt 23 is locked to the fixing member 22, the bolt 23 is engaged with one of the positioning slots 211 and connected with the nut 24. This can adjust the first stage of length of the stock 30. In the drawing, the first stage of length is represented by "B".

Figure 11:
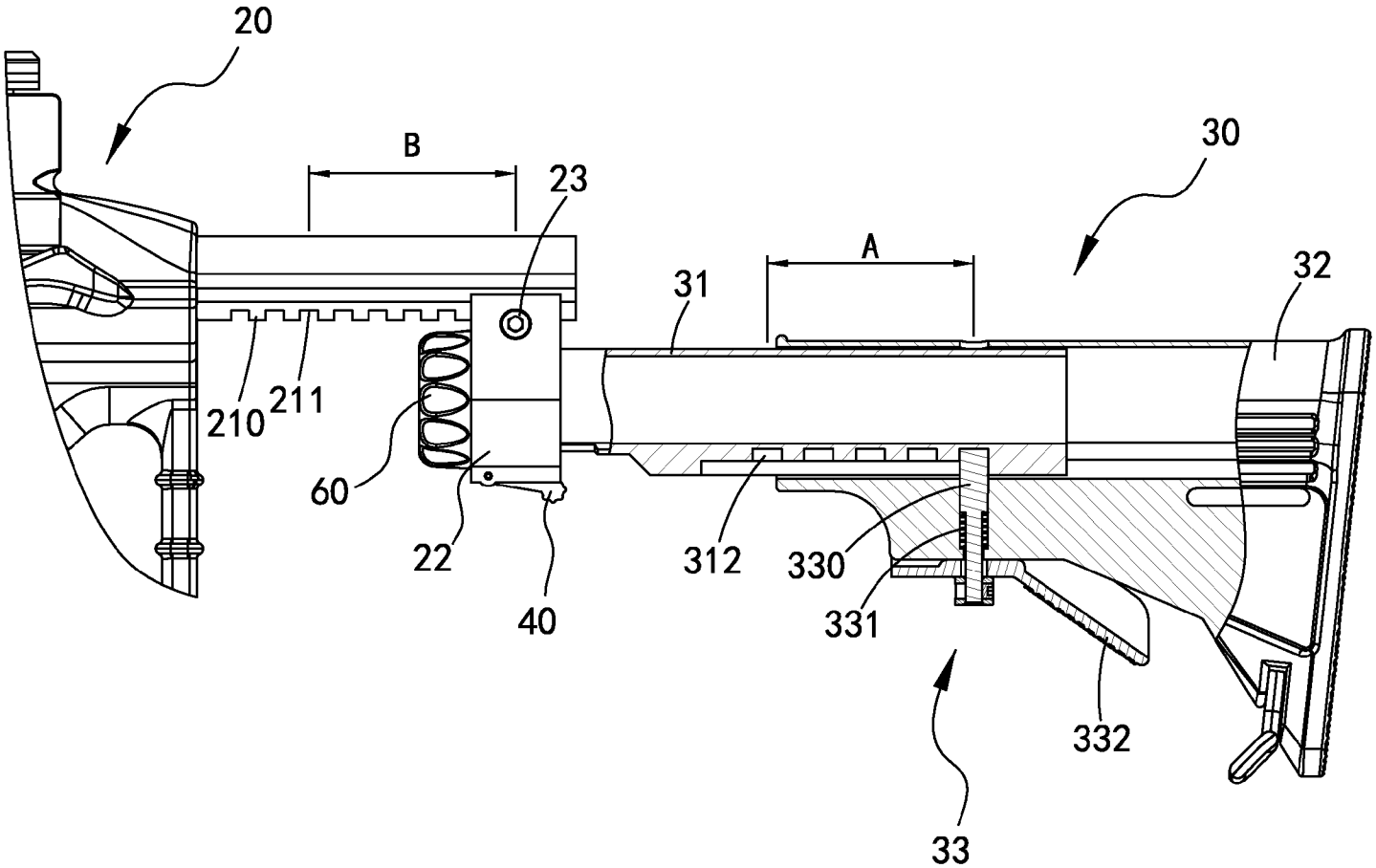
FIG. 11 shows the second stage of length of the stock assembly relative to the main body of the crossbow of the present invention.

FIG. 11 shows that the extension 31 has multiple positioning holes 312. The adjustment device 33 has a positioning pin 330, a positioning spring 331 and a control member 332. The positioning pin 330 is located in the stock part 32. The positioning spring 331 is biased between the stock part 32 and the positioning pin 330 so as to push the top end of the positioning pin 330 to be inserted into one of the positioning holes 312. The control member 332 is connected to the stock part 32 and connected to the lower end of the positioning pin 330. The top end of the positioning pin 330 is removed from the positioning hole 312 by pivoting the control member 332. By pushing the control member 332, the second stage of length of the stock 30 relative to the main body 20 can be adjusted. In the drawing, the second stage of length is represented by "A".

The stock 30 can be adjusted relative to the main body 20 in total of the length "A+B", so that the users of different sizes can use the crossbow.

While we have shown and described the embodiment in accordance with the present invention, it should be clear to those skilled in the art that further embodiments may be made without departing from the scope of the present invention.

What is claimed is:

1. A crossbow comprising:

a main body, a connection rod extending from a rear end of the main body, a fixing member connected to the connection rod and having a threaded hole defined therethrough;

a stock having an extension and a stock part, the extension having a threaded section formed on a front end thereof, the threaded section being threadedly connected with the threaded hole of the fixing member, an axial groove defined axially in an outside of the threaded section and communicating with a front end of the threaded section, the stock connected to the extension;

a locking member pivotably connected to the fixing member and being capable of pivoting between a locked position and a release position, the locking member having an engaging end and a press end on two ends thereof, the engaging end engaged with the axial groove when the locking member is located at the locked position, the engaging end separated from the axial groove when the locking member is located at the release position;

a spring being biased between the fixing member and the locking member to bias the locking member at the locked position, and a collar having a threaded inner periphery and a restriction groove defined in one side of the collar and communicating with the threaded inner periphery, the threaded inner periphery threadedly connected to the threaded section of the extension, the engaging end of the locking member engaged with the restriction groove to keep the locking member at the locked position.

2. The crossbow as claimed in claim 1, wherein the connection rod has a rail formed on an underside thereof, multiple positioning slots defined transversely through the rail, the fixing member has a sliding slot and a through hole which is defined through two sidewalls of the sliding slot, the rail is slidably engaged with the sliding slot, a bolt extends through the through hole and is engaged with one of the positioning slots, a nut is connected to the bolt.

3. The crossbow as claimed in claim 2, wherein the rail and the sliding slot are dovetail-shaped.

4. The crossbow as claimed in claim 1, wherein the fixing member has two lugs which are parallel to each other, the locking ember is pivotably connected between the two lugs by extending a pivot through the two lugs.

5. The crossbow as claimed in claim 1, wherein a stud extends from the fixing member and the press end of the locking member has a notch, a first end of the spring is mounted to the stud and a second end of the spring is received in the notch.

6. The crossbow as claimed in claim 1, wherein the collar has anti-slip grooves defined in an outer periphery thereof.

7. The crossbow as claimed in claim 1, wherein the stock has an adjustment device connected thereto, the stock part is axially mounted to a rear end of the extension, the adjustment device positions the stock part to the extension.

8. The crossbow as claimed in claim 1, wherein the extension has multiple positioning holes, the adjustment device has a positioning pin, a positioning spring and a control member, the positioning pin is located in the stock part, the positioning spring is biased between the stock part and the positioning pin so as to push a top end of the positioning pin to be inserted into one of the positioning holes, the control member is connected to the stock part and connected to a lower end of the positioning pin, the top end of the positioning pin is removed from the positioning hole by pivoting the control member.

* * * * *